United States Patent [19]

Gergoe

[11] Patent Number: 4,805,346

[45] Date of Patent: Feb. 21, 1989

[54] VEHICLE DOOR GLASS ATTACHMENT TO CABLE DRIVE WINDOW REGULATOR MECHANISM

[75] Inventor: Bela Gergoe, Birmingham, Mich.

[73] Assignee: General Motors Corporation, Detroit, Mich.

[21] Appl. No.: 94,118

[22] Filed: Sep. 4, 1987

[51] Int. Cl.[4] ..... E05F 11/48

[52] U.S. Cl. ..... 49/352; 49/360

[58] Field of Search ..... 49/352, 358, 489, 360

[56] References Cited

U.S. PATENT DOCUMENTS

| | | | |
|---|---|---|---|
| 4,199,899 | 4/1980 | Muhling et al. | 49/352 |
| 4,423,566 | 1/1984 | Hess et al. | 49/352 |
| 4,468,887 | 9/1984 | Koch | 49/352 |
| 4,502,247 | 3/1985 | Kobayashi et al. | 49/352 |
| 4,614,061 | 9/1986 | Brocke | 49/489 X |
| 4,631,864 | 12/1986 | Barros | 49/352 |
| 4,663,886 | 5/1987 | Nakamura et al. | 49/352 X |
| 4,700,508 | 10/1987 | Kollner et al. | 49/352 |

FOREIGN PATENT DOCUMENTS

| | | | |
|---|---|---|---|
| 2620249 | 12/1977 | Fed. Rep. of Germany | 49/352 |
| 1563210 | 4/1969 | France | 49/352 |
| 2080411 | 2/1982 | United Kingdom | 49/358 |

*Primary Examiner*—Kenneth J. Dorner
*Assistant Examiner*—James R. Brittain
*Attorney, Agent, or Firm*—William A. Schuetz

[57] ABSTRACT

An attachment for readily connecting and disconnecting a tensioned cable of a cable drive window regulator mechanism to a movable window of a vehicle door assembly comprises a ferrule secured to the cable which is guided for movement in opposite directions along a guide track and a slider or sash plate which is molded to the window and slidably supported on the guide rail. The sash plate has an integrally molded boss portion defining a ferrule receiving pocket and a through slot to enable the cable to be pulled therethrough against its tension bias and the sash plate to then be positioned behind the ferrule to align the pocket with the ferrule whereupon the cable can be released and with the tension bias causing the ferrule to be moved within the pocket to drivingly connect the same to the sash plate.

8 Claims, 4 Drawing Sheets

262
104
246
22
18
154
152
160
202
242
134
200
260
1306
136
136
130
130a
120
24
100
110
180a
20
190
194
195
180
208
186
230
114
206
204
194
184
218
109
220
216
148
146
186
194
214
116
180b
193
142
144
230
102
120
112
12
210
212
132a
136
132
162
102
134
136
132b
106

144
120
146
150
276
200
140
295
278
150
142
260
266
148
242
240
310
102
22

144
150
140
295
290
242
146
120
142
100
148
22
260
266
288
240
280
286
295
102

VEHICLE DOOR GLASS ATTACHMENT TO CABLE DRIVE WINDOW REGULATOR MECHANISM

The present invention relates to a door assembly for an automotive vehicle and, more particularly, to a novel attachment means for readily connecting and disconnecting a movable window of the door assembly to a cable of a cable drive window regulator mechanism.

Heretofore, cable drive window regulator mechanisms have been provided for raising and lowering a window of an automotive vehicle door assembly. These mechanisms have included a cable movable in opposite directions, a sash plate secured to the window and slidably supported on a guide rail or post and a mechanical connecting means for securing the cable to the sash plate so that when the cable is moved in opposite directions it moves the sash plate along the guide rail or post to raise and lower the vehicle window. While these known mechanisms have been satisfactory in operation, the window and sash plate cannot be readily disconnected from the remainder of the cable drive window regulator mechanism should service be required.

In accordance with one of the provisions of the present invention, a novel quick connect and disconnect attachment or connection means is provided for attaching a cable of a cable drive window regulator mechanism to a sash plate which is secured to the movable window and slidably supported on a guide rail of the window regulator mechanism. In accordance with another provision of the present invention, a second quick connect and disconnect attachment means is provided for readily connecting and disconnecting the sash plate from the guide rail of the window regulator mechanism once the other attachment for connecting the cable to the sash plate is disconnected.

Accordingly, a broad object of the present invention is to provide a new and improved attachment means for connecting a movable window of a vehicle door assembly to a cable of a cable drive window regulator mechanism and which is of a relatively simple and economical construction, has a minimal number of parts and which can be readily connected and disconnected.

Another object of the present invention is to provide a new and improved attachment means, as defined in the next preceding object, and in which the attachment means comprises a ferrule secued to a tensioned cable of the window regulator mechanism and a sash plate which is adapted to be secured to the window, preferably by molding the same thereon, and slidably received on a stationary guide rail of the window regulator mechanism, and in which the sash plate has a boss portion thereon defining a ferrule receiving pocket and a through slot means therein to freely receive the cable but not the ferrule and wherein the cable can be readily connected to and disconnected from the sash plate by positioning the sash plate on the guide rail above the ferrule, pulling on the tensioned cable to move the same through the slot and then lowering the sash plate to position the pocket adjacent the ferrule and then releasing the cable to allow the tensioned cable to move the ferrule within the pocket and biasingly retain the same therein.

Yet another object of the present invention is to provide a new and improved attachment means, as defined in the next preceding object, and wherein the boss portion of the sash plate below the lower end of the pocket is tapered to define a ramp for engaging and camming the ferrule outwardly of the sash plate until it is positioned adjacent the pocket whereupon the tensioned cable will biasingly move the ferrule within the pocket to drivingly connect the same to the sash plate.

A further object of the present invention is to provide a new and improved attachment means, as defined in the preceding objects, and wherein the sash plate also has first and second vertically spaced guides for freely slidably engaging opposite side flanges of the guide rail, the sash plate being readily disconnectable from the guide rail, when also disconnected from the ferrule on the cable, by lowering the sash plate so that the lower guide passes through a cutout in the guide rail and then rotating or cocking the sash plate and window to disconnect the upper guide from the guide rail.

Another object of the present invention is to provide a new and improved vehicle door assembly having a lower door body and an upper inverted door frame having top and front and rear sides extending within the lower door body, a window supported for movement between open and closed positions and which is slidably guided by the frame along its sides, a cable drive window regulator mechanism supported by the lower door body and including a stationary, a generally vertically extending guide means which is adapted to be secured to the lower door body, a cable drive means including a cable which is guided for movement in opposite directions along the guide means, biasing means for tensioning the cable and a ferrule secured to the cable and having a width which is wider than the diameter of the cable, a sash plate which is adapted to be secured to the window adjacent its lower end and which is slidably supported on the guide means, the sash plate having a boss portion which defines a ferrule receiving pocket having upper and lower walls, a bottom wall and an opening which faces in a direction away from the stationary guide means, and a cable receiving slot which extends through the end walls and bottom of the boss portion defining the pocket and with the slots having a width which is less than the width of the ferrule but greater than the width of the cable to freely receive the latter, the cable being readily connected to the sash plate by positioning the backside of the sash plate over the cable above the ferrule so that the cable can be received through the slot, pulling on the cable in opposition to its tension biasing means to move the ferrule to the front of the sash plate and the cable through the slot, moving the sash plate and window to position the pocket of the sash plate behind the ferrule and then releasing the cable to allow the tension biasing means to move the ferrule into the pocket and biasingly retain the same therein to drivingly connect the ferrule to the boss portion to the sash plate due to the engagement between the ferrule and the ends of the pocket, and with the cable being readily disconnected from the sash plate by reversing the above-noted procedure.

A further object of the present invention is to provide a new and improved vehicle door assembly, as defined in the next preceding object, and in which the upper frame is of a one piece molded plastic construction and has an outer flange for engaging the window adjacent its outer sidemost and topmost portions when in a closed position, and an inner flange spaced inwardly from the outer flange to which an elastomeric seal means is secured, and wherein the seal means includes deflectable means, preferably a pair of spaced deflectable fingers, for engaging the window along its interior at its sides and top to provide a seal and for biasing the window into engagement with the outer flange of the upper frame so that the window is substantially flush therewith when in its closed position.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
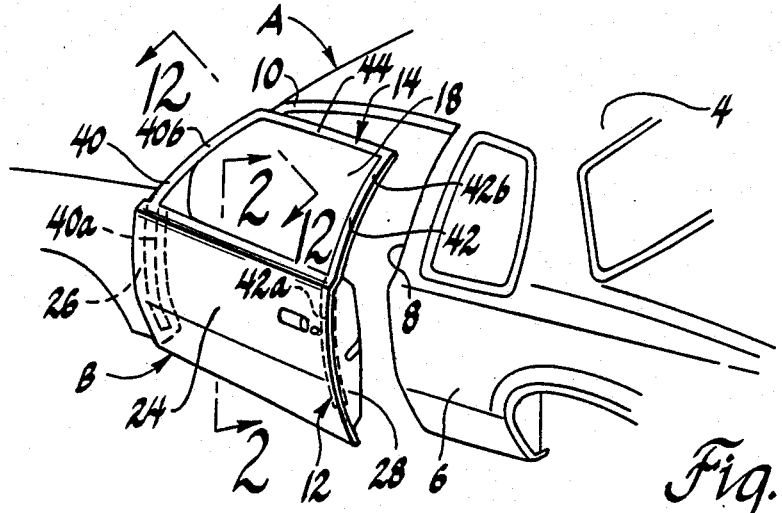
FIG. 1 is a fragmentary perspective view of an automotive vehicle incorporating the novel door assembly of the present invention.

Referring to FIG. 1 of the drawings, an automotive vehicle A having a door assembly B is thereshown. The automotive vehicle A has a roof 4 and side body structure 6 which defines a door opening 8. The door assembly B is adapted to be suitably hinged adjacent its left or front end, as shown in FIG. 1, to the vehicle body structure 6 at its A pillar 10 for movement between open and closed positions to permit ingress and egress to and from the vehicle A via the door opening 8, and in a manner which is conventional.

The door assembly B comprises, in general, a lower door body 12, an upper inverted generally U-shaped frame 14, a stationary seal means 16 carried by the frame 14, a window 18 which is supported for movement between open and closed positions, a cable drive window regulator mechanism 20 supported by the lower door body 12 and an attachment means 22 for readily attaching and detaching the window 18 to the window regulator mechamism 20. The window regulator mechamism 20 when attached to the window 18 is operable to move the latter up and down between the open and closed positions.

The lower door body 12 comprises spaced inner and outer panels 23 and 24 and spaced fore and aft ends or panels 26 and 28 and a bottom wall 30 which may be integral with the inner panel. The inner and outer panels 23 and 24, ends 26, 28 and the bottom 30 are suitably secured together and define a well 34 having an elongated slot or opening 36 at its upper end, which end also defines a belt line for the door assembly B. The outer panel 24 of the lower door body 12, in the illustrated embodiment, is suitably detachably connected to the rest of the lower body 12 to enable the outer panel 24 to be removed from the remainder of the lower door body 12 so as to permit access to the interior 34 of the lower door body 12 for service purposes.

The upper frame 14 is generally U-shaped, as viewed in side elevation in FIG. 1, and is of a one piece molded plastic construction. The frame 14 comprises front and rear sides 40, 42 and a top 44. The sides 40 and 42 have lower portions 40*a*, 42*a* which extend well into the interior 34 of the lower door body 12 and which are suitably rigidly secured to the fore and aft ends 26, 28 of the lower door body 12. The sides 40, 42 also have upper portions 40*b* and 42*b* which are integral with the top 44. The rear side 42, as viewed in side elevation, is linear throughout its length and the upper front side 40 portion 40*b* is curved. The lower portion 40*a* of the side 40 and the side 42 extend parallel to each other.

Figure 12:
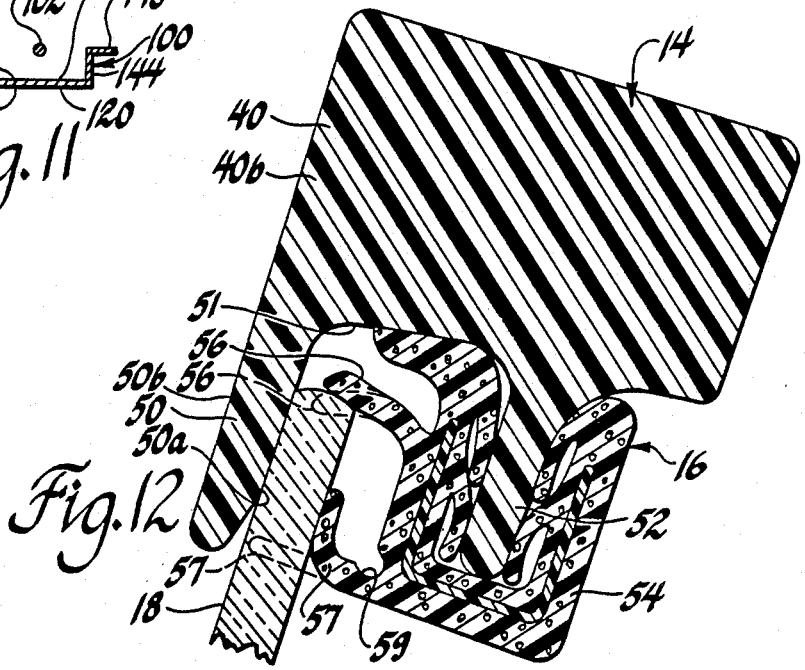
FIG. 12 is a cross sectional view taken along the lines 12—12 of FIG. 1.

The frame 14 is made of a one piece plastic construction and is generally U-shaped, as viewed in cross section, as best shown in FIG. 12. The sides 40, 42 have their open ends facing each other and the top 44 has its open end facing toward the top edge of the window 18. The upper frame 14 has an outermost flange 50 which lies in a plane which is parallel with the plane of the window 18, a bottom 51 and a inner continuous flange 52 spaced inwardly from the outer flange 50 for carrying the seal means 16. The seal means 16 comprises a body portion 54 which is press fitted over the inner flange 52 in a conventional fashion so as to be securely attached thereto. The seal means 16 also includes deflectable means or portions in the form of a pair of spaced fingers 56, 57 which extend toward the outer flange 50. The fingers 56, 57 have a normal free state position, as shown by the phantom lines in FIG. 12, but are readily deflectable upon engaging the window 18 on its inner side surface adjacent its side edges so as to provide a seal and to bias the outer surface of the window 18 into engagement with the inner surface 50*a* of the outer flange 50. The seal means 16 is coextensive with the periphery of the frame 14. The finger 57 is undercut, as indicated by the reference numeral 59 in FIG. 12, so as to be more readily deflectable than the finger 56.

From the foregoing, it should be apparent that the seal means 16 provides both a seal for the window 18 when the latter is in its closed position and serves to bias the window at its top and along its sides outwardly against the inner surface 50*a* of the outer flange 50 so that the window 18 is flush or substantially flush with exterior surface 50*b* of the outer flange 50.

Figure 2:
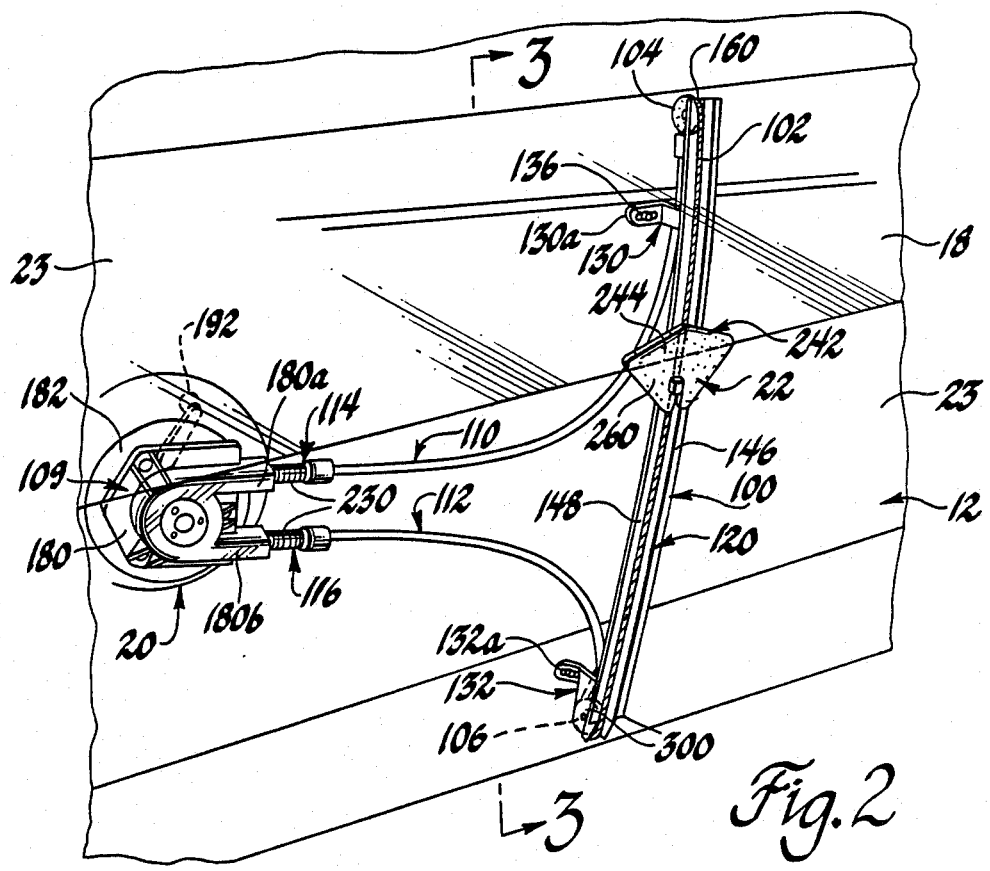
FIG. 2 is a fragmentary side elevational view of the novel vehicle door assembly of the present invention and showing the outer panel removed.
Figure 3:
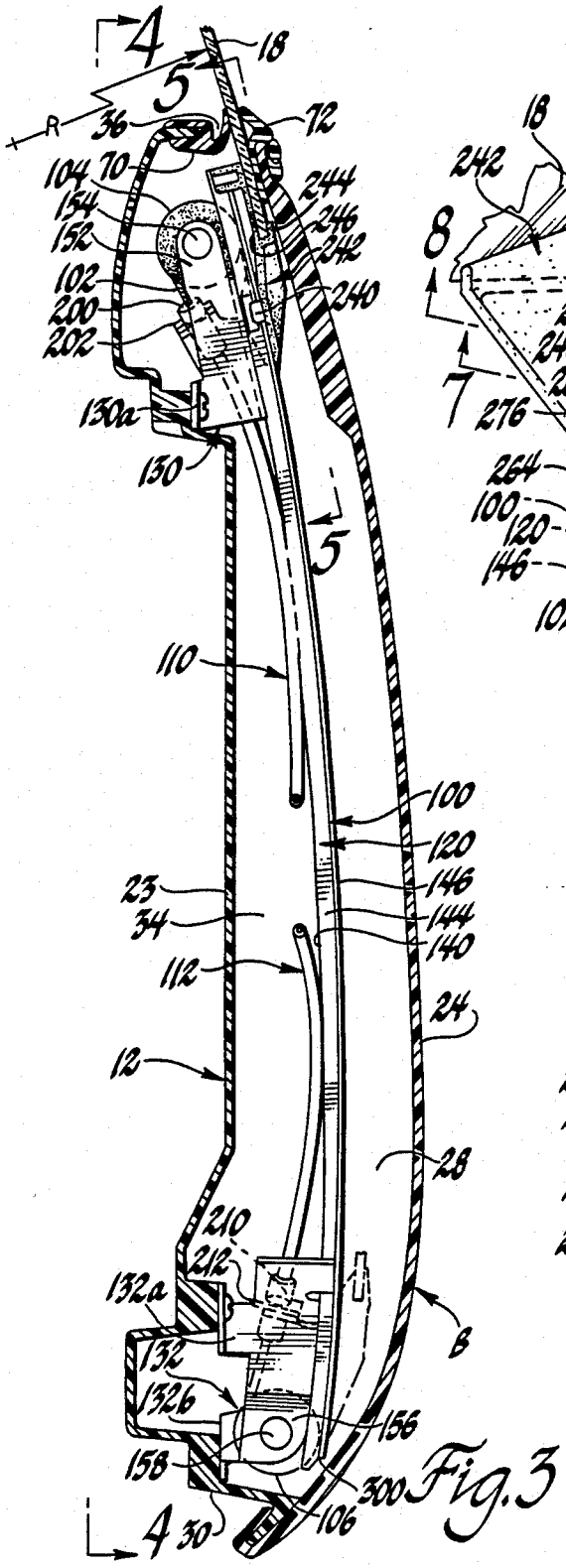
FIG. 3 is an enlarged cross sectional view taken in the direction of the arrows 3—3 of FIG. 2.

The window 18 can be of any suitable or conventional material, such as glass, and is hereshown as being curved and having a radius of curvature R, as best shown in FIG. 3. The window 18 as it moves between its open and closed positions, engages the deflectable fingers 56, 57 of the seal means 16 along its inner sides and when in its upper closed position, as shown by the solid lines in FIG. 2 or FIG. 5, also engages the fingers 56, 57 of the seal means 16 at the upper side 44 of the frame 14. In addition to the seal means 16 carried by the upper frame 14, the door assembly B also includes a pair of seals 70 and 72 adjacent the belt line 36 of the lower door body 12. The seal 70 is suitably secured to the inner door panel 23 and extends laterally across the window 18 at the belt line 36 and engages the window 18 along its inner surface. The seal 72 is suitably carried by the outer panel 24 of the lower door body 12 at its belt line 36 and is adapted to engage the window 18 along its outer or exterior surface. The seals 70 and 72 are each readily deflectable and are in constant engagement with the window 18.

The window 18 is adapted to be raised and lowered for movement between its open and closed positions by the cable drive window regulator means 20 which is operatively connected therewith via the attachment means 22. The window regulator means 20 is preferably a preassembled unit which can be readily mounted to the inner panel 23 of the lower door body 12.

The cable window regulator mechanism 20 comprises, in general, a generally vertically extending guide means 100 which is adapted to be secured to the inner panel 23 of the lower door body 12, a cable 102 which is trained over a pair of vertically spaced idler pulleys 104 and 106 rotatably supported by the guide means 100 so that it travels through a path of movement along the guide means 100 and which has its opposite ends operatively connected with a cable actuating means 110 which is secured to the inner panel 23 of the lower door body 12, a pair of cable sheaths 110 and 112 for slidably housing portions of the cable 102 and which have one end rigidly connected with the guide means 100 and its other end slidably connected with the cable actuating means 110 and spring tension biasing means 114 and 116 for tensioning the cable 102.

The guide means 100 comprises a vertically extending hat shaped channel 120 which extends parallel with the front and rear sides 40 and 42 of the frame 14, as viewed in side elevation from the door exterior, and which is curved in a vertical direction, as viewed in end elevation in FIG. 3, so as to have the same radius of curvature as the window 18. The guide channel 120 is secured to the inner panel 23 of the lower door body 12 via suitable upper and lower brackets 130, 132 rigidly secured to the channel 120 adjacent its upper end and adjacent its lower end, respectively. The brackets 130, 132 include flanges **130*a*, 130*b* and 132*a*, 132*b* having elongated horizontally extending openings or slots 134 through which suitable bolts 136 for securing the flanges 130, 132 to the inner panel 23 can pass. The provision of the horizontally extending slots 134 enables the guide channel 120 to be adjustably positioned so that it extends parallel to the front and rear sides 40, 42 of the upper frame 14**.

Figures 4, 7, 8:
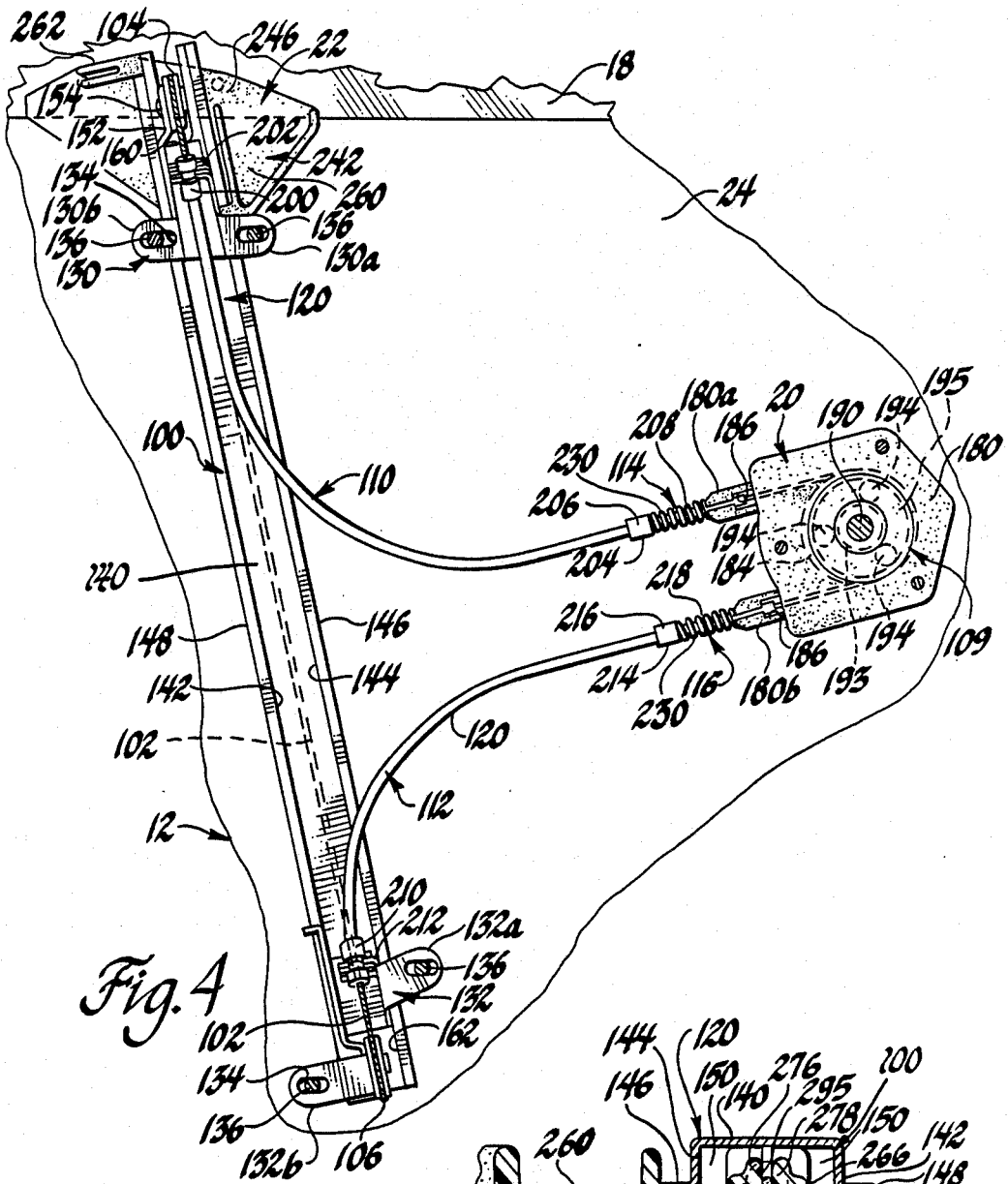
FIG. 4 is an enlarged side elevational view of part of the door assembly shown in FIG. 3 and showing the same with the inner panel removed.
FIG. 7 is a cross sectional view taken along the lines 7—7 of FIG. 5.
FIG. 8 is a cross sectional view taken along the lines 8—8 of FIG. 5.
Figure 9:
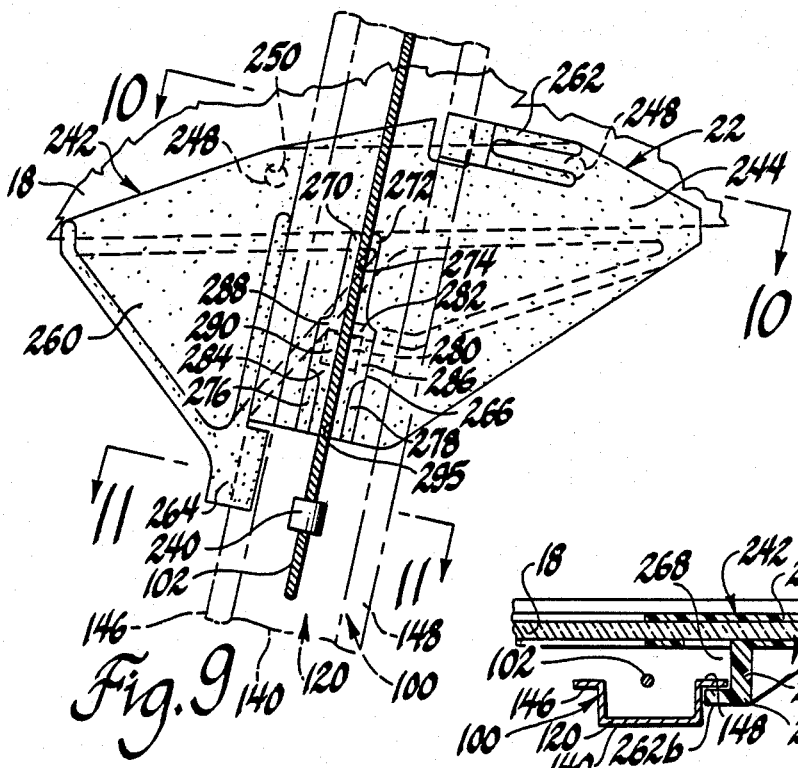
FIG. 9 is a view like FIG. 5, but showing parts thereof in different positions.
Figure 10:
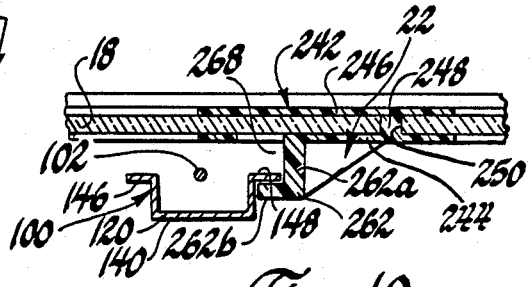
FIG. 10 is a cross sectional view taken along lines 10—10 of FIG. 9.

As best shown in FIGS. 4, 7 and 8, the guide channel 120 has a bottom 140, a pair of side walls 142, 144 extending perpendicularly thereto and outer flanges 146, 148 extending perpendicular to the side walls 142, 144. The bottom 140 and side walls 142, 144 define a trough or recess 150 facing outwardly toward the outer door panel 22. The outer flange 146 extends toward the rear end 28 of the door body 12 and the outer flange 148 extends toward the front end 26 of the door body 12 and the flanges 146, 148 lie in a plane which is generally parallel to the plane of the window 18.

The bracket 130 also includes an integral ear or flange 152 disposed on the rear side of the guide channel 120 for rotatably supporting the idler pulley 104 via a suitable pivot pin means 154. Likewise the bracket 132 has an ear or flange 156 disposed on its rear side for rotatably supporting the idler pulley 106 via a pivot pin means 158. The cable 102 extends around the idler pulleys 104 and 106 and is received through slots 160, 162 in the bottom 140 of the guide channel 120 at its upper and lower ends so that the cable 102 can pass through the bottom 140 and be disposed within the trough 150 on the side of the bottom 140 facing toward the outer door panel 24, as best shown in FIG. 2.

The cable actuating means 110 could be of any suitable or conventional construction and is hereshown as comprising a housing 180 which is adapted to be secured to a boss portion 182 on the inner panel 23 via suitable screws or bolts. The housing 180 at one side rotatably supports via a stub shaft a grooved cable drum 184 to which opposite ends of the cable 102 are wound a few turns and secured. The housing includes a pair of spaced projecting housing portions **180*a*, 180*b*, each having a through opening 186 therethrough through which the cable 102 passes, the openings 186 also extending through the main housing portion to enable the cable 102** to pass therethrough.

The actuating means 110 further includes an actuator shaft 190 rotatably supported by the other side of the housing 180 and which extends through aligned openings in the other side of the housing 180 and the inner panel 23 of the lower door body 12 and to which a suitable actuator handle 192 is adapted to be fixedly secured. The shaft 190 at its other end has a sun gear 193 fixed thereto which is in meshed engagement with three annularly spaced planetary gears 194, the planetary gears 194 in turn being in meshed engagement with an internal ring gear 195 which is integral with the cable drum 184. From the foregoing, it should be apparent that rotation of the actuator handle 192 causes the shaft 190 and sun gear 193 to be rotated which in turn causes the planetary gears 194 to rotate the ring gear 195 integral with the drum 184. Rotation of the drum 184 causes one end of the cable 102 to be wound up on the drum while the other end of the cable is caused to be moved away from the drum 184. In other words, as the cable 102 is wound in one direction it is unwound in the other direction to cause the cable 102 to be moved along the guide track 120.

The sheath 110 is preferably made from plastic and has a suitable ferrule 200 rigidly connected thereto to one end, the ferrule 200 in turn being rigidly secured to a flange 202 on the bracket 130. The sheath 110 adjacent its other end has a suitable ferrule 204 rigidly connected thereto. The ferrule 204 includes a large diameter portion 206 and a smaller, but longer diameter portion 208 through which the cable 102 slidably passes. The small diameter portion 208 of the ferrule 204 is slidably received within the opening 186 of the housing portion **180*a* of the housing 180 of the cable actuating mechanism 110. Likewise the cable sheath 112 at one or adjacent its rightmost end, as viewed in FIG. 4, is rigidly secured to a ferrule 210 which in turn is rigidly secured to a flange 212 on the lower bracket 132. The other end of the sheath 112 is secured to a ferrule 214 having a large diameter portion 216 and a smaller, but longer diameter portion 218. The smaller diameter portion 218 of the ferrule 214 is slidably received within the opening 186 of the housing portion 180*b* of the housing 180 of the actuating means 110**.

The cable 102 is tensioned by the tension biasing means 114 and 116. The tension biasing means 114, 116 comprise a compression spring 230 having one end in abutting engagement with one of the housing portions 180*a*, 180*b* and its other end in abutting engagement with one of the large diameter portions 206 and 216 of the ferrules 204 and 214. It should be noted at this point that the length of the cable 102 is such that when the cable drive window regulator mechanism is preassembled as a unit the sheaths 110, 112 are caused to be bowed to their configuration shown in FIG. 4 and the ferrules 204, 214 to slide further into the housing portions 180*a* and 180*b* to compress compression springs 114, 116 so that the cable 102 will be pretensioned and biased toward engagement with the bottom 140 of the guide channel 120.

The attachment means 22 for readily connecting and disconnecting the cable 102 of the cable drive window regulator mechanism 20 with the window 18 comprises a ferrule 240, preferably made of metal, which is suitably secured to the cable 102 and has a diameter which is wider or greater than the diameter of the cable 102 and a slider or sash plate 242 rigidly secured to the window 18 adjacent its lower end. The tensioned cable 102 causes the ferrule 240 to be biased into engagement with the bottom 140 of the guide track 120 when the ferrule 240 is not connected to the sash plate 242. The sash plate 242 has the configuration shown in FIGS. 4–10 and is of a one piece molded plastic construction. The sash plate 242 adjacent its upper end includes a pair of spaced plate portions 244 and 246 through which the lower end of the window 18 is received. The plate portions 244, 246 thus straddle the lower end of the window 18. The sash plate 242 is adapted to be molded in place on the lower end of the window 18 and connected thereto via a pair of integral rivets 248 which extend through a pair of openings 250 in the lower end of the window 18 and which are formed during the molding operation to securely retain the sash plate 242 to the lower end of the window 18.

Figure 11:
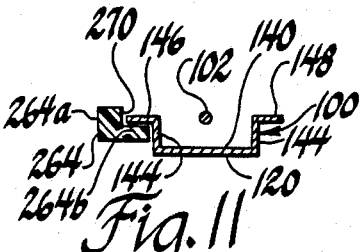
FIG. 11 is a cross sectional view taken along the lines 11—11 of FIG. 9.

The sash plate 242 also includes a generally planar lower base portion 260, a first upper guide means or guide 262, a second lower guide means or guide 264 and a generally vertically extending boss portion 266. The upper and lower guides 262, 264 are formed integral with the plate portion 244 and the base portion 260, respectively, and are generally L-shaped, as viewed in FIGS. 10 and 11. Thus, the guides 262, 264 have a first wall portion 262*a*, 264*a* extending transversely of the plate 244 and base portion 260 and a second wall portion 262*b*, 264*b* extending generally parallel with the plane of the guide channel 120. The L-shaped guides 262, 264 define recesses 268, 270 for receiving the opposite side flanges 148, 146 of the guide channel 120 so as to slidably connect the sash plate or slider 242 to the guide channel 120.

Figure 5:
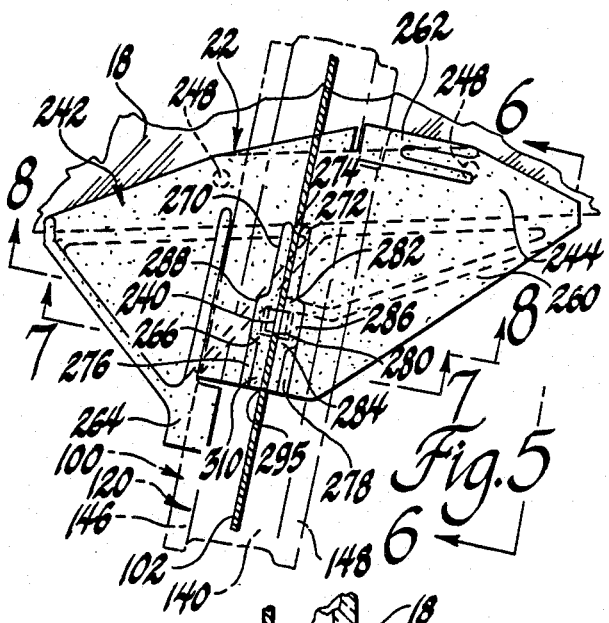
FIG. 5 is an enlarged elevational view of part of the door assembly shown and looking in the direction of the arrows 5—5 of FIG. 3.
Figure 6:
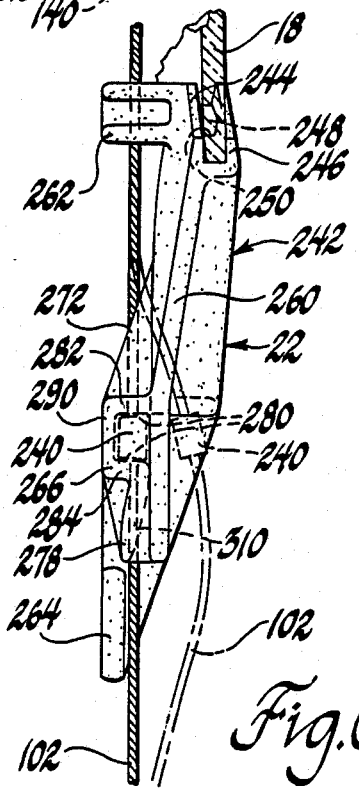
FIG. 6 is a cross sectional view taken along the lines 6—6 of FIG. 5.

The boss portion 266 is formed integral with the base portion 260 on its side facing toward the trough 150 in the guide channel 120. As best shown in FIGS. 5 and 6, the boss portion 266 along its upper end includes a pair of horizontally spaced but vertically extending wall portions or ribs 270, 272 which define a cable receiving recess 274 therebetween. The base portion 260 forms the bottom of the recess 274. It also includes a pair of horizontally spaced but vertically extending wall portions or ribs 276, 278 adjacent its lower end for receiving the cable 102. In addition, the boss portion 266 intermediate its upper and lower ends is formed so as to define a pocket 280 facing toward the outer door panel 22. The pocket 280 is defined by a pair of end walls 282, 284, a pair of side walls 286, 288 and a bottom wall 290. The pocket 280 is shaped complementary with the shape of the ferrule 240 connected to the cable 102. The end walls 282, 284 and bottom wall 290 defining the pocket 280, the base portion 260 between the lower ribs 276, 278 and the base portion 260 between the upper ribs 270 and 272 adjacent the end wall 282 have a vertically extending through slot 295 through which the cable 102 can pass. The width of the slot 295 is such that it enables the cable 102 to pass therethrough but not the ferrule 240. The sash plate or slider 242 is also provided with suitable ribs at various locations to strengthen the plastic part and to make it rigid.

The slider or sash plate 242, which is integrally molded to the lower end of the window 18, is adapted to be readily connected to the cable drive window regulator mechanism 20. The sash plate 242 and window 18 are first positioned adjacent the lower end of the guide track 120 and the upper guide 262 positioned so that its recess 268 receives the flange 148 on the guide track 120. In this position, the lower guide 264 will be positioned adjacent a cutout 300 at the lower end of the flange 146 of the guide track 120. The cutout 300 enables the guide 264 to move toward the guide track 120 so that its recess 270 can receive the lower end of the flange 146 on the guide track 120. The sash plate 242 and window can then be raised so that both guides 262 and 264 are slidably connected to the flanges 148 and 146 of the guide track 120.

The sash plate 242 is then adapted to be connected to the ferrule 240 of the cable 102 by positioning the backside of the sash plate 242 over the cable 102 extending through the trough 150 of the guide track 120 and at a location above the ferrule 240 so that the cable 102 can be received through the through slot 295. Then the cable 102 is grasped adjacent or at the ferrule and pulled in opposition to the tension biasing forces of the springs 114, 116 to move the cable 102 through the slot 295 and to move the ferrule 240 to the front of the sash plate 242. It should be noted that when the springs 114, 116 are compressed when the cable 102 pulled out of the trough 150 of the guide track 120, it causes the sheaths 110, 112 to move slightly away from each other to accommodate the cable movement. The sash plate 242 and window 18 are then moved downwardly to position the pocket 280 on the sash plate 242 behind the ferrule 240 and then the cable 102 is released to allow the springs 114, 116 to again move the cable 102 and ferrule 240 toward the bottom 140 of the guide track 120 and cause the ferrule 240 to be moved into the pocket 280 and into engagement with its bottom 290 and to biasingly retain the same therein. When the ferrule 240 is received within the pocket 280, it is drivingly connected to the sash plate 242 by virtue of the engagement between the ferrule 240 and the upper and lower end walls 282, 284 of the boss portion 266 defining the pocket 280.

To aid in connecting the ferrule 240 to the sash plate 242, the boss portion 266 along its lower portion is tapered so as to define a ramp 310 straddling the through slot 295. Thus, when the cable 102 is pulled forwardly to position the ferrule 240 in front of the sash plate 242, the ferrule 240 can engage the tapered ramp 310 and be cammed outwardly of the sash plate 242 until it is positioned adjacent the pocket 280 whereby the spring forces of the springs 114, 116 will cause the ferrule 240 to be moved within the pocket 280.

Likewise, the cable 102 can be readily disconnected from the sash plate 242 by pulling on the cable 102 to remove the ferrule 240 from the pocket 280 and then moving the sash plate 242 and window 18 upwardly to release the cable 102 therefrom.

It should also be noted that the sash plate 242 and window 18 can be readily removed from the guide track 120 when the sash plate 242 is disconnected from the ferrule 240. To this end, sash plate 242 and window 18 can be lowered to position the lower guide 264 on the sash plate 242 at the cutout 300 at the bottom of the guide track 120. The sash plate 242 at its left end, as viewed in FIG. 2, can then be moved outwardly to clear the guide 264 from the flange 146 of the guide track 120. The sash plate 242 can then be moved to the right to clear the guide 262 from the flange 148 of the guide track 120. When the sash plate 242 is disconnected from the guide track 120, the window can be rotated or cocked to remove the same from the frame 14. This latter movement can take place due to the configuration of the window 18 and the side clearance between the side edges of the window 18 and the bottom 53 of the frame 14, which clearance is best shown in FIG. 12.

It should be further noted that although the window regulator mechanism 20 is shown in the preferred embodiment as being mounted to the inner panel 23 of the lower door body 12 and can be serviced by removing the outer panel, that it could also be mounted to the outer door panel, and be serviced by removing the inner door panel, if desired.

From the foregoing, it should be apparent that a novel attachment means for readily connecting and disconnecting a cable of a cable drive window regulator mechanism with a window has been provided. It should be further obvious that the attachment means is a quick connect and disconnect attachment means, is of a very simple and economical construction and has only a minimal number of parts.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In combination, a cable drive window regulator mechanism and an attachment means for attaching a movable window of a vehicle door assembly to the regulator mechanism comprising:

a stationary generally vertically extending guide means which is adapted to be secured to the door assembly, a cable drive means including a cable which is guided for movement in opposite directions along said guide means and biasing means for tensioning said cable;

a sash plate which is adapted to be secured to the window adjacent its lower end and which is slidably connected to and supported on said guide means;

connecting means for connecting said cable to said sash plate so that when the cable is moved the sash plate and window are slidably moved relative to said guide means to raise and lower said window, the improvement being that said connecting means comprises:

a ferrule secured to said cable and which has a width greater than the diameter of said cable;

and that said sash plate has a boss portion which defines a ferrule receiving pocket having upper and lower end walls, a bottom wall and an opening which faces in a direction away from said stationary guide means, and a cable receiving slot which extends through said boss portion including the end walls and bottom thereof defining said pocket and with said slot having a width which is less than the width of the ferrule but greater than the width of the cable to freely receive the latter, said boss portion having a ramp located beneath said pocket, said cable being readily connectable to said sash plate, after the latter is slidably connected to said guide means, by positioning the backside of said sash plate over said cable above the ferrule so that the cable can be received through said slot, pulling on said cable in opposition to its tension biasing means to move the ferrule to the front of the sash plate and the cable through the slot, moving the sash plate and window downward and releasing the cable and with the ferrule being engageable with said ramp of said boss portion until the pocket on the sash plate is positioned behind the ferrule whereupon the tension biasing means moves the ferrule into the pocket and biasingly retains the same therein to drivingly connect the ferrule to the boss portion of the sash plate due to the engagement between the ferrule and the upper and lower end walls of the pocket, said cable being readily disconnected from said sash plate by pulling said ferrule and cable outwardly and reversing the procedure noted above.

2. In combination, a cable drive window regulator mechanism and an attachment means for attaching a movable window of a vehicle door assembly to the regulator mechanism comprising:

a stationary generally vertically extending guide means which is adapted to be secured to the door assembly, a cable drive means including a cable which is guided for movement in opposite directions along said guide means and biasing means for tensioning said cable;

a sash plate which is adapted to be secured to the window adjacent its lower end and which is connected to and slidably supported on said guide means for up and down movement;

connecting means for connecting said cable to said sash plate so that when the cable is moved the sash plate and window are slidably moved relative to said guide means to raise and lower said window, the improvement being that said connecting means comprises:

a ferrule secured to said cable and which has a width greater than the diameter of said cable;

and that said sash plate has a base and a boss portion on the base which together define an upper cable receiving recess on one side of the base, a lower cable receiving slot through said boss portion and base which is vertically aligned with said recess and an intermediate ferrule receiving pocket having upper and lower end walls, a bottom wall spaced from said one side of said base and an opening in communication with the other side of said base, said upper and lower end walls and bottom wall of said pockets also having through slots therein aligned with said lower cable receiving through slot whereby the cable extends in said recess on said one side of said base and through said slots to the other side of said base, said boss portion along and adjacent its lower cable receiving slot being tapered to define a ramp leading to said pocket, said cable being readily connectable with said sash plate by positioning said sash plate over said cable above the ferrule so that the cable is received within said recess and slot, pulling on said cable in opposition to its tension biasing means to move the ferrule away from the sash plate, moving the sash plate and window downwardly and releasing said cable and with the ferrule engaging said ramp and being cammed outwardly of the sash plate until the ferrule is positioned adjacent the pocket whereupon the tension biasing means moves the ferrule into the pocket and biasingly retains the same therein to drivingly connect the ferrule to the boss portion of the sash plate due to the engagement between the ferrule and the upper and lower end walls of the pocket, said cable being readily disconnected from said sash plate by pulling the ferrule and cable outwardly of the pocket and reversing the procedure noted above.

3. A vehicle door assembly comprising a lower door body having an elongated top opening at its belt line and an inverted generally U-shaped upper frame defining a window opening and which has a top and front and rear sides extending into and secured to the lower door body, a window extending through the top opening and whose sides are slidably guided by said front and rear sides of said upper frame, a sash plate secured to said window adjacent its lower end and a cable drive window regulator mechanism carried by the lower door body and operatively connected to the sash plate for raising and lowering the window between open and closed positions, said regulator mechanism comprising a channel shaped guide track which has its open side facing toward the plane of the window and has front and rear laterally extending flanges and which is secured to the lower door body and which extends parallel with the front and rear sides of said upper frame, and a cable drive means including a cable which is guided for movement in opposite directions within said guide track, a ferrule connected to said cable and having a width wider than said cable and a biasing means for tensioning said cable so that the ferrule is biased toward sliding engagement with said guide track at its bottom, said sash plate having a first guide adjacent its upper end which slidably receives one of said lateral flanges of said track, a second guide adjacent its lower end which slidably receives the other of said lateral flanges of said track whereby said guides slidably connect the sash plate to said guide track and a boss portion intermediate its upper and lower ends which defines a ferrule receiving pocket having upper and lower end walls, a bottom wall disposed within said track and an opening facing away from said track, said boss portion including said end walls and bottom having a through slot through which the cable may pass and said boss portion beneath said pocket being tapered to define a ramp straddling said through slot, said cable being readily connectable to said sash plate by positioning said sash plate over said cable above the ferrule so that the cable extends along its backside, pulling on said cable in opposition to its tension biasing means to move the ferrule out of said guide track, moving the sash plate and window downward to position the sash plate behind the ferrule and then releasing the cable to allow the tension biasing means to move the ferrule into engagement with the boss portion, moving the sash plate and window further downward and with the ferrule engaging said ramp and being cammed outwardly until the ferrule is positioned adjacent said pocket whereupon the tension biasing means will snap the ferrule into the pocket and biasingly retain the same therein to drivingly connect the ferrule to the boss portion of the sash plate due to the engagement between the ferrule and the upper and lower end walls of the pocket, said cable being readily disconnected from said sash plate by pulling the cable to remove the ferrule from the pocket and then raising the window and sash plate to a position above the ferrule and releasing the cable, at least one of said outer flanges of said guide track at its lower end being provided with a cutout to allow the second guide to be moved outwardly to release said sash plate from said guide track to readily enable the sash plate to be disconnected from the guide track and reconnected thereto.

4. A vehicle door assembly, as defined in claim 3, and wherein said upper frame is made from plastic and has an outer flange for engaging the window adjacent its outer sidemost and topmost portions when in a closed position and an inner flange spaced inwardly from the outer flange to which an elastomeric seal means is secured, said seal means including deflectable means for engaging the window at its interior along its sides for providing a seal and for biasing the window into engagement with the outer flange of the upper frame so that said window is substantially flush with the exterior of the upper frame when in its closed position.

5. A vehicle door assembly, as defined in claim 4, and wherein said deflectable means of said seal means includes a pair of spaced deflectable fingers.

6. A door assembly, as defined in claim 5, and wherein said sash plate is of a one-piece molded construction.

7. A door assembly, as defined in claim 3, and wherein said first and second guides are L-shaped as viewed in cross-section to define recesses for receiving the outer flanges on the guide track.

8. A sash plate as defined in claim 3 and wherein the window has at least two holes therethrough adjacent its lower edge and said sash plate is molded directly to the window so that integral rivets extending through the holes are formed to securely retain the sash plate to the window.

* * * * *